US005904643A

United States Patent [19]

Seeberger et al.

[11] Patent Number: 5,904,643

[45] Date of Patent: May 18, 1999

[54] TRAY-FORMING AND APPARATUS

[75] Inventors: Edward J. Seeberger, Dublin; Harold H. Hayes III, Grove City; Vaughn R. Bryson, Gahanna, all of Ohio

[73] Assignee: Tenneco Packaging, Evanston, Ill.

[21] Appl. No.: 08/874,231

[22] Filed: Jun. 13, 1997

[51] Int. Cl.[6] ..... B31B 01/25

[52] U.S. Cl. ..... 493/59; 493/61; 493/82; 493/373; 493/167; 425/351

[58] Field of Search ..... 83/681, 684; 425/398, 425/399, 400, 412, 351; 493/59, 61, 82, 143, 167, 355, 373, 902

[56] References Cited

U.S. PATENT DOCUMENTS

| | | | |
|---|---|---|---|
| 308,098 | 11/1884 | Robertson | 493/902 |
| 1,844,500 | 2/1932 | Dailey . | |
| 2,492,886 | 12/1949 | Punte | 493/61 |
| 3,983,827 | 10/1976 | Meadors | 113/121 A |
| 4,127,378 | 11/1978 | Meadors | 425/398 |
| 4,149,841 | 4/1979 | Patterson | 425/398 |
| 4,228,121 | 10/1980 | Meadors | 264/291 |
| 4,242,293 | 12/1980 | Dowd | 264/40.7 |
| 4,246,223 | 1/1981 | Patterson | 264/292 |
| 4,435,143 | 3/1984 | Dempsey | 425/150 |
| 4,456,164 | 6/1984 | Foster et al. | 229/43 |
| 4,497,620 | 2/1985 | Dempsey | 425/145 |
| 4,637,811 | 1/1987 | Fortney | 493/167 |
| 4,642,086 | 2/1987 | Howarth | 493/355 |
| 4,690,666 | 9/1987 | Alexander et al. | 493/152 |
| 4,691,604 | 9/1987 | Carmichael | 83/164 |
| 4,755,128 | 7/1988 | Alexander et al. | 425/292 |
| 4,778,439 | 10/1988 | Alexander | 493/169 |
| 5,041,071 | 8/1991 | Reasinger et al. | 493/167 |
| 5,052,992 | 10/1991 | Hyder | 493/62 |
| 5,087,236 | 2/1992 | Morimoto | 493/342 |
| 5,098,363 | 3/1992 | Reasinger et al. | 493/167 |
| 5,129,874 | 7/1992 | Hayes, III et al. | 493/167 |
| 5,140,882 | 8/1992 | Hyder | 83/620 |
| 5,230,939 | 7/1993 | Baum | 428/84 |
| 5,319,910 | 6/1994 | Takata et al. | 493/61 |
| 5,496,250 | 3/1996 | Fielder et al. | 493/373 |
| 5,577,989 | 11/1996 | Neary | 493/169 |

FOREIGN PATENT DOCUMENTS

| | | | |
|---|---|---|---|
| 0 683 035 A1 | 11/1995 | European Pat. Off. | B31B 43/00 |
| WO 90/14993 | 12/1990 | WIPO | B65B 43/08 |

OTHER PUBLICATIONS

"Variformer 640/860" Brochure, Gietz+Co.

"The Ice–PT21 Combination Paper Plate And Tray Forming Machine And Blank Feeder" Brochure, International Converting Equipment, Inc.

"Paper–Plate Machine–System VP" Brochure, Markhorst.

*Primary Examiner*—James F. Coan
*Assistant Examiner*—Gene L. Kim
*Attorney, Agent, or Firm*—Arnold White & Durkee

[57] ABSTRACT

A process and apparatus for forming three-dimensional containers from a continuous flat web of paper, coated paper, paper board, or laminated paper board ("paper") in which the paper is first scored to define the shape of the container and, thereafter, the scored stock is simultaneously cut and formed into a container. Containers so produced have improved uniformity. The apparatus is less expensive and easier to operate than conventional equipment, and it is easier to change from one style of tray to another. The apparatus also makes possible tray styles which could not be made with machines which cut and transfer paper blanks to a separate forming station.

30 Claims, 8 Drawing Sheets

TRAY-FORMING AND APPARATUS

BACKGROUND OF THE INVENTION

This invention relates to the method and apparatus used to manufacture three-dimensional containers. More particularly, the invention relates to making three-dimensional trays from flat stock by cutting and pressing it into the desired form.

Trays of paper, coated paper, paper board, or laminated paperboard (hereinafter "paper") are commonly used as food containers; for example, in frozen food packaging and as fresh food containers in supermarkets and delicatessens. These inexpensive trays are made in large quantities by machines designed to transform rolls of flat paper stock into three-dimensional containers. High quality containers are not required by all customers, but very often the containers must meet strict uniformity standards in order to be acceptable. In such instances, each finished tray must be identical with the others. Achieving a highly uniform product in large quantities has proven to be very difficult.

Machines which have been developed to make three-dimensional containers (i.e., trays) from rolls of flat paper stock are quite complex. They feed the stock into the machine intermittently and movement of the paper stops while the tray is being made. After each tray (or set of trays depending on the machine design) has been made, it (or they) is ejected and the paper stock moved into position for the next tray to be formed.

Such machines normally cut blanks from a sheet of flat paper stock after first scoring the paper in a pattern which is appropriate for the type of tray to be formed. If the trays are shallow and do not require scoring, it is possible to slit the paper stock and then cut off pieces which are formed at the same time. The present invention relates to the manufacture of deeper trays which are scored before the trays are formed. The scoring permits the paper to be formed into the desired shape more easily. Scoring does not mean cutting through the paper stock, but refers to an operation in which a set of knives are pressed down into corresponding recesses in an opposed plate. The edges of the knives press into the paper to form indentations where the sides of the tray are to be made, particularly at the corners. The effect of the scoring will be familiar to anyone who has handled a tray made by pressing. After scoring, the paper stock is usually moved into another station where a scored blank is removed from the stock, either by punching or cutting. The separated blanks then are moved to a tray-forming station where they are formed over a mandrell, i.e., the male part of a die set having the shape of the tray.

Conventional paper tray-forming machines have a number of deficiencies. Some of the problems experienced with such machines should be mentioned so that the advantages achieved by the present invention can be appreciated. As just described, previous machines score the paper stock first, then cut and separate blanks from which the trays are formed and finally transfer the blanks to the tray-forming station. It is difficult to assure that each separated blank is moved to the forming station with the proper orientation. Blanks may turn, and it is common for blanks to reach the forming die improperly aligned. A tray produced from a misaligned blank may be rejected for defects, such as being misshapen or as having improper orientation of imprinted designs. Even if not rejected, the trays may be undesirably non-uniform. Non-uniform trays give a poor impression to the customer who receives them and do not work well in automated equipment. Also, non-uniform trays can stack poorly and take up more space in shipping containers, thereby increasing material and transportation costs.

Another problem associated with misalignment of paper blanks is related to the orientation of the fibers in the paper stock. It typically has the fibers principally aligned in one direction (the "machine direction"), as is the case with wood, and it is stronger in that direction. When the paper is formed over a die, force is applied to the paper while it is held by the edges of the blank. If the blank is misaligned, the paper may tear because of the variation in strength related to the fiber orientation. If the paper fibers in each blank are always aligned in the same direction when a tray is formed, then the effect of the variation in paper strength is always the same. Consequently, any variation in the final product resulting from the orientation of the fibers could be compensated for by changing the shape of the dies. This is not possible without consistent alignment of the blanks.

Still other problems relate to the moisture content of the paper. The paper stock may be preconditioned to provide a desired amount of moisture so that the paper can be formed over a die. If there is too little moisture, the paper may tear. If there is too much moisture, the paper will be distorted during the forming process. Also, just after the tray has been formed, relief of residual stresses from the forming process and drying of the paper can cause the tray to change shape. The tray will form the desired shape if it was properly oriented when it was formed. If not, then a permanently deformed tray may result.

It is common to heat the dies over which the paper stock is drawn during forming to assist removing the moisture and to help fix the shape of the tray. Excessive heating can cause softening of plastic coatings leading to sticking of the trays in the forming dies. Non-uniform thermal expansion of the dies may also cause problems in the manufacturing process. It will be appreciated that the clearances between the die parts are close and that heating one die may change such clearances.

Conventional tray-forming machines are difficult to adjust and maintain. Many of these problems are associated with the need to transfer a cut paper blank to the forming dies. It is typical that the blank is cut, and then transported by gravity to forming dies mounted at an angle to the horizontal. In that case, since the forming die set is mounted at an angle, it is very difficult to position and adjust in place because of its weight and size. Furthermore, mounting the die at an angle causes non-uniform wear on the moving parts. An important factor in properly forming a three-dimensional tray from a flat paper blank is maintaining the clearances between the die parts. They are more difficult to adjust and control when the forming die is mounted at an angle.

It was clear that a need existed for an improved tray-forming machine which would be easier to set up and adjust. If tray quality could be improved at the same time, making possible higher quality products and fewer rejects, a major advance in the tray-forming technology would have been made. The present inventors have achieved such results with a new tray-forming process and machine. It adopts a different principle of operation compared with that of the prior art machines. These benefits are made possible by simultaneously cutting and forming a tray from a strip of paper stock in a single die with a single stroke. This eliminates the problems relating to the cutting and transfer of a paper blank, as will be seen in the discussion which follows.

SUMMARY OF THE INVENTION

In one aspect, the invention is a process for making three-dimensional containers, generally referred to as trays, in which a section of a continuous strip of flat paper, coated paper, paper board, or laminated paper board (i.e., "paper") is scored in a manner appropriate to the shape of the tray to be formed, while a previously scored region of the paper is simultaneously cut and formed into a tray in a single stroke. Thus, misalignment of the blanks is eliminated and more uniform trays result.

A region of the paper stock is scored at the same time as a previously scored region is cut and formed. After each tray is formed, it is ejected by a plunger disposed within the forming cavity before the paper stock is moved. The residual paper stock moves the tray away from the forming station and, thereafter, the residue is removed as waste, preferably by a vacuum system. A conveyor is provided to move each tray from the forming station to a stacking station where the trays are accumulated for subsequent packing and shipping.

A control system is provided to unroll sufficient paper stock from a roll so that it is available for advancement into the scoring and forming stations. The continuous web of paper stock is advanced intermittently a length equal to, or typically a fraction of, the distance between the centerline of the scoring station and the centerline of the forming station. In a preferred embodiment, the paper is advanced a length which is one-half the distance between the centerlines. This is typically accomplished by a pinch roll system which is synchronized with movement of the press (to be discussed), and which moves a fixed increment of the paper stock into the machine where it is scored and formed into trays. When printed paper stock is being fed, a registration system aligns the pattern with the scoring and forming stations. The portion of the paper stock being advanced through the scoring and tray-forming steps is retained with guides at the edges to avoid buckling.

Since the blanks are not cut and then moved by gravity to a tray-forming station as in many other machines, both the scoring station and the forming station can be located horizontally, thus providing significant advantages. The scoring plate and the tray-forming cavity are mounted horizontally on a moveable die shoe in a hydraulic or mechanical press and move vertically to accomplish their tasks. The press is capable of infinite adjustment of its vertical travel and of the dwell time at its closed position.

In another aspect, the invention is a machine for forming three-dimensional containers (trays) from a continuous web of paper stock. It provides a means for transferring an increment of the paper stock from a roll on an intermittent basis into a scoring station, where it is scored appropriately for the tray to be formed, and then to a tray-forming station, where the scored stock is simultaneously cut and formed into a tray. The scoring and tray forming occur at the same time on different locations on the paper stock with a single stroke of the press. Alignment of the tray is assured since a blank is not cut out and then moved separately to a forming station. Each movement of the paper stock advances the paper a distance equal to, or a fraction of, the distance between the centerline of the scoring station and the centerline of the tray-forming station. Scoring is done by a set of knives mounted on the base of a hydraulic or mechanical press which mate with a set of recessed grooves in the moveable portion of the press. The plate containing recessed grooves descends with the moveable die shoe of the press, and knives mounted below the paper stock compress the paper stock in a pattern appropriate to the shape of the tray about to be formed. The cutting and forming station comprises a forming cavity, a blanking punch, and a stripper plate, each mounted on the moving die shoe of the press and cooperating parts on the fixed base of the press that is a forming punch, a blanking die, and a draw ring. When the movable die shoe travels downward, the paper stock is cut and formed into a tray in a single stroke. The blanking punch is mounted on the moveable die shoe at the outer edge of the forming cavity. It cuts the paper stock into the desired shape as it descends. The resulting piece of paper stock is caught at its edges between the draw ring and the edge of the forming die cavity and pulled downward. When it reaches the end of its vertical movement, a tray has been formed between the forming cavity and the mating forming punch of the die set. The die shoe then moves upward, and an ejector which has formed the bottom of the forming cavity is moved downward to eject the tray. The ejected trays are preferably moved out of the tray-forming station by the next movement of the web of paper stock, and then carried by a conveyor to a stacking station for subsequent packing and shipment. The portion of the paper stock which has not been cut and formed into a tray is removed as waste, preferably by a vacuum system downstream of the forming station.

DESCRIPTION OF THE PREFERRED EMBODIMENTS

Prior Art Machines With Blank Cutting Station

Figure 1A:
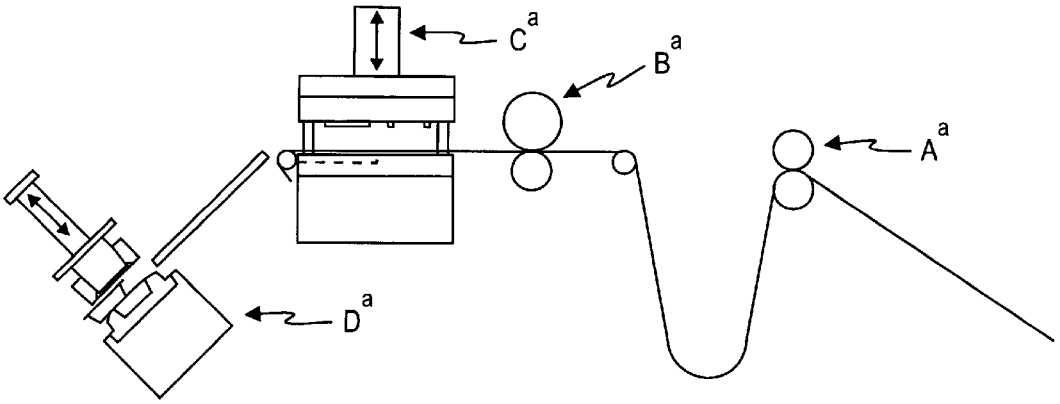
FIGS. 1*a–c* are schematic diagrams of tray-forming machines of the prior art.
Figure 1B:
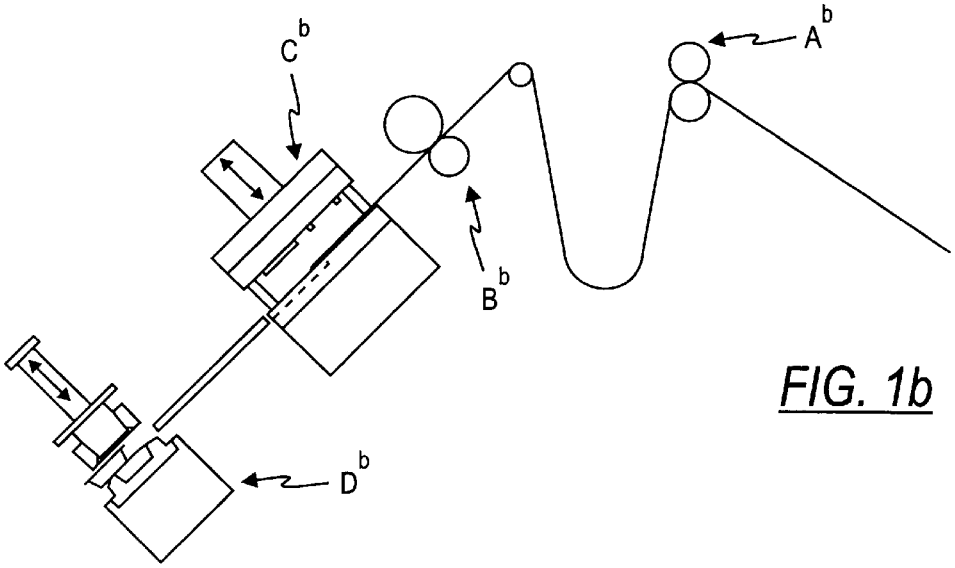
Figure 1C:
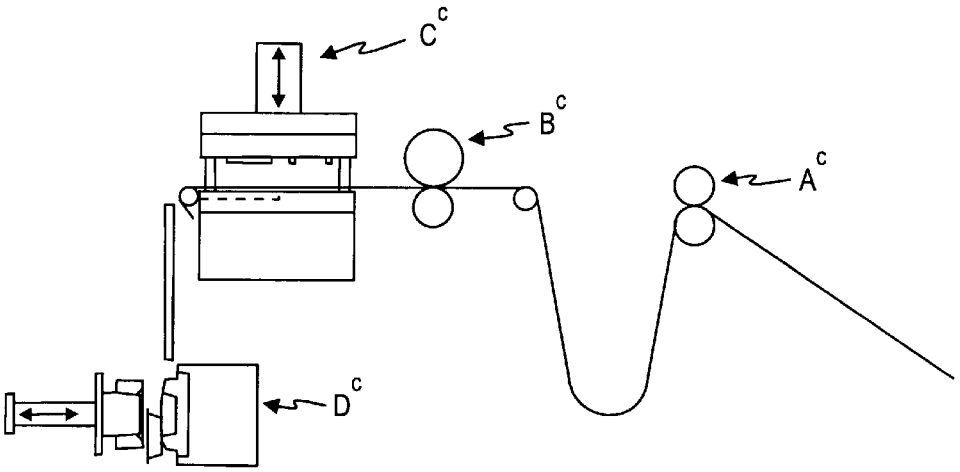

FIG. 1*a–c* show schematic side views of three typical tray-forming machines in which the paper stock is maintained in one piece only until a blank has been cut. The paper stock is fed from a roll (not shown) through a loop to accommodate the intermittent feeding of the stock into the scoring and blank cutting stations. The paper is pulled from the bulk roll by pinch rollers A on a continuous basis, and the second set of pinch rollers B advance a predetermined length of the paper stock intermittently as required. The second set of pinch rollers B coordinates with the operation of the cutting and scoring section C, which scores the paper stock in a similar manner to the cow scoring section of the present invention. After scoring the paper stock, however, it is moved to the cutting station where a blank is cut, either by punching or by steel rules. Since the scoring and cutting stations are located above the tray-forming section D in each of the three arrangements, the blanks, which have now been separated from the paper stock, are free to move downward under the force of gravity to the tray-forming station. It is this free fall which creates the misalignment problems discussed above and which have been overcome in the present invention by not allowing the paper freedom of movement until the trays have been formed.

Three possible arrangements are illustrated in FIG. 1. In FIG. 1*a*, the scoring of the paper stock and subsequent cutting of the blanks takes place in a horizontally-mounted station $C^a$ located above the tray-forming station $D^a$ so that the blanks slide down under the force of gravity. In FIG. 1*b*, the scoring and blank cutting station $C^b$ is mounted at the same angle from the horizontal as the tray-forming station $D^b$. In FIG. 1*c*, the scoring and blank cutting station $C^c$ is mounted horizontally as in FIG. 1*a*, but here the blanks drop vertically into the tray-forming section $D^C$. Avoiding such arrangements is highly desirable, as will be seen below in the discussion of the tray-forming machine of the invention.

The mounting of scoring, blank cutting and tray-forming tools at an angle with the horizontal, as illustrated in FIGS. 1*a–c*, creates practical difficulties in maintaining equipment and changing the tools from one style of tray to another, as discussed above. In short, such machines are cumbersome to operate and maintain. Alignment of the tools is often difficult, and frequent adjustments are necessary to prevent rejects and to assure quality. However, the equipment generally does not permit ready adjustment and alignment, particularly when the heavy tooling is mounted at an angle with the horizontal.

GENERAL ARRANGEMENT OF THE MACHINE OF THE INVENTION

Figure 2:
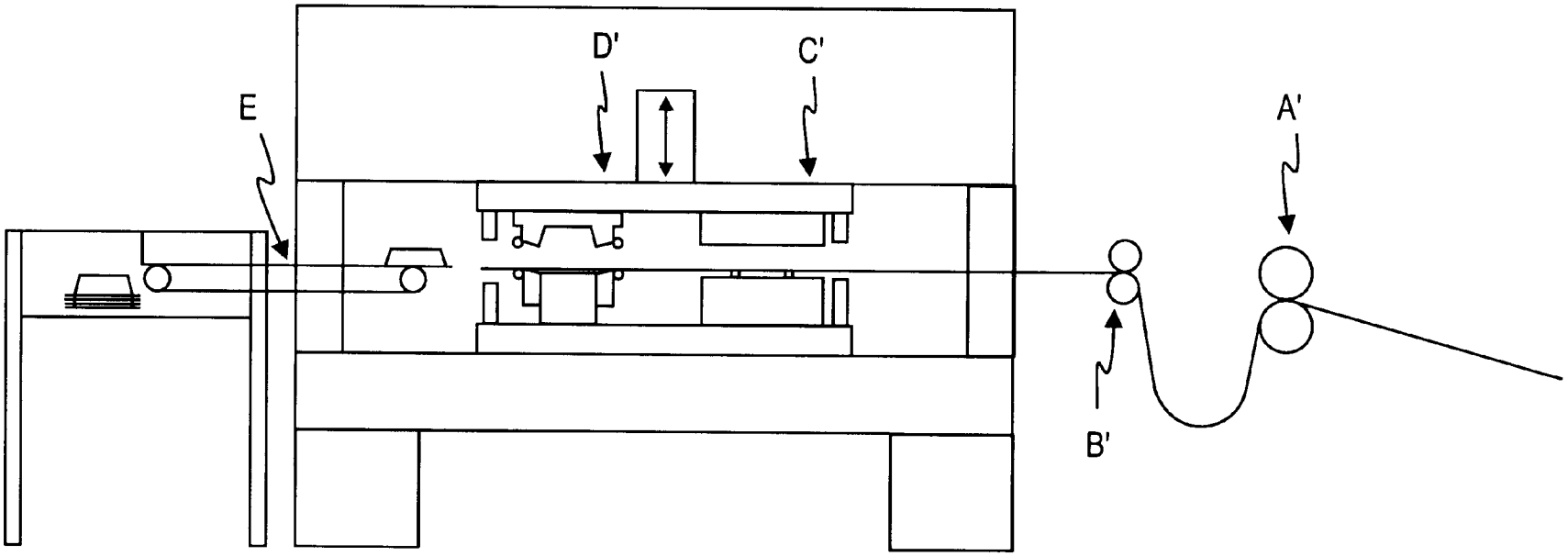
FIG. 2 is a schematic diagram of a tray-forming machine of the invention.

Before discussing the important details of the machine according to the invention, the major differences from the conventional types of equipment shown in FIGS. 1*a–c* may be seen in FIG. 2. The major difference, which is readily apparent, is that the paper web travels horizontally and not at an angle. This means that the maintenance and changeover of the tooling is much simpler. As before, the paper is fed into the machine by pinch rollers $A^1$ from a roll (not shown). Again, a loop of paper stock is needed to compensate for the periodic feeding of the stock into the machine. A set of pinch rollers $B^1$ forces the strip of paper stock into the press at regular intervals, indexing the stock so that it moves forward exactly the distance required. This is equal to, or more typically a fraction of, the distance between the centerline of the scoring station $C^1$ and the centerline of the cutting and forming station $D^1$. For example, if the size of the equipment permits, a scored region of the paper stock could be moved directly to the cutting and forming station. If not, it may take two movements of the web, that is, the movement each time is one-half the distance between the centerlines of the scoring and forming stations. In other embodiments of the invention, the equipment design and the size of the tooling may require that the paper stock be moved in smaller increments, say one-third or one-fourth the distance between the centerlines. A registration system is used when a printed paper stock is being formed into trays to assure that the pattern appears where intended on the finished tray.

In the machine of the invention, the paper is not cut to form a blank which is moved independently to the tray-forming die set. Consequently, the paper stock is continuous from the original roll until the tray has been formed and ejected, thus eliminating any possible misalignment of the tray. With a single stroke, a section of the paper stock is scored and a section already scored in a previous stroke is cut and formed into a tray. The trays are moved by the next movement of the paper web onto a conveyor E, which may be an air conveyor table, and then moved to the stacking station. The portion of the paper stock which has not been converted into trays is removed as waste. This is conveniently done by a vacuum system (not shown) located above the end of the forming station. The waste paper can be reclaimed and recycled into other products.

The tools which are used to score the paper stock at the scoring station $C^1$ and to cut and form the tray at the cutting and forming station $D^1$ are mounted on a die shoe, which is moved vertically by a hydraulic or mechanical press. This vertical movement is more uniform than that experienced with the presses shown in FIG. 1, where some or all of the tooling is mounted at an angle with the horizontal. The pressure is more uniform and the wear more evenly distributed. Whether operated hydraulically or mechanically, the press should have the flexibility to vary pressure, making it possible to control the force applied to the paper stock during scoring and forming as well as the dwell time, an important factor in determining the quality of the trays produced.

SCORING AND FORMING STATIONS

Figure 3A:
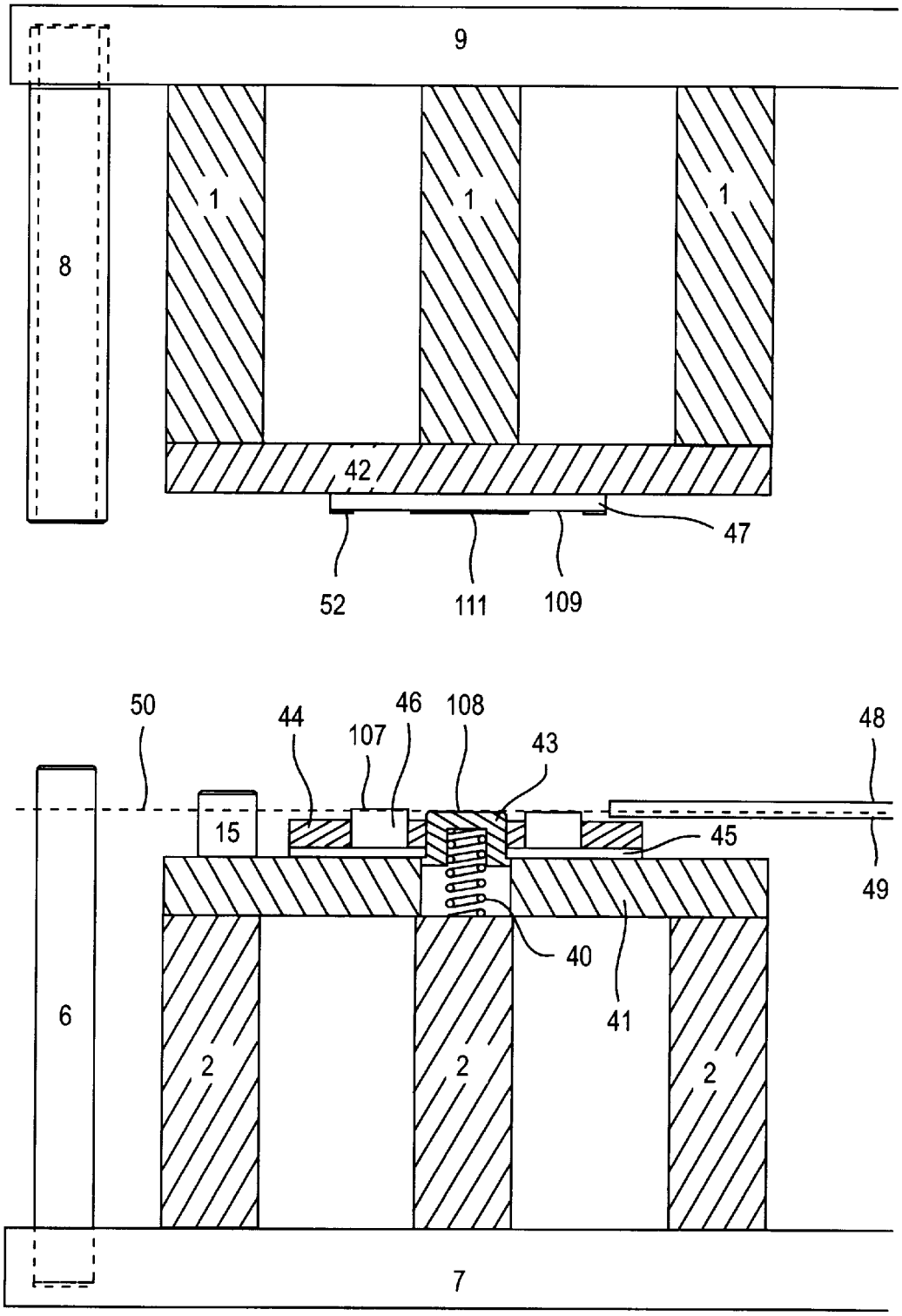
FIGS. 3*a–b* are elevation views of the scoring and forming stations.
Figure 3B:
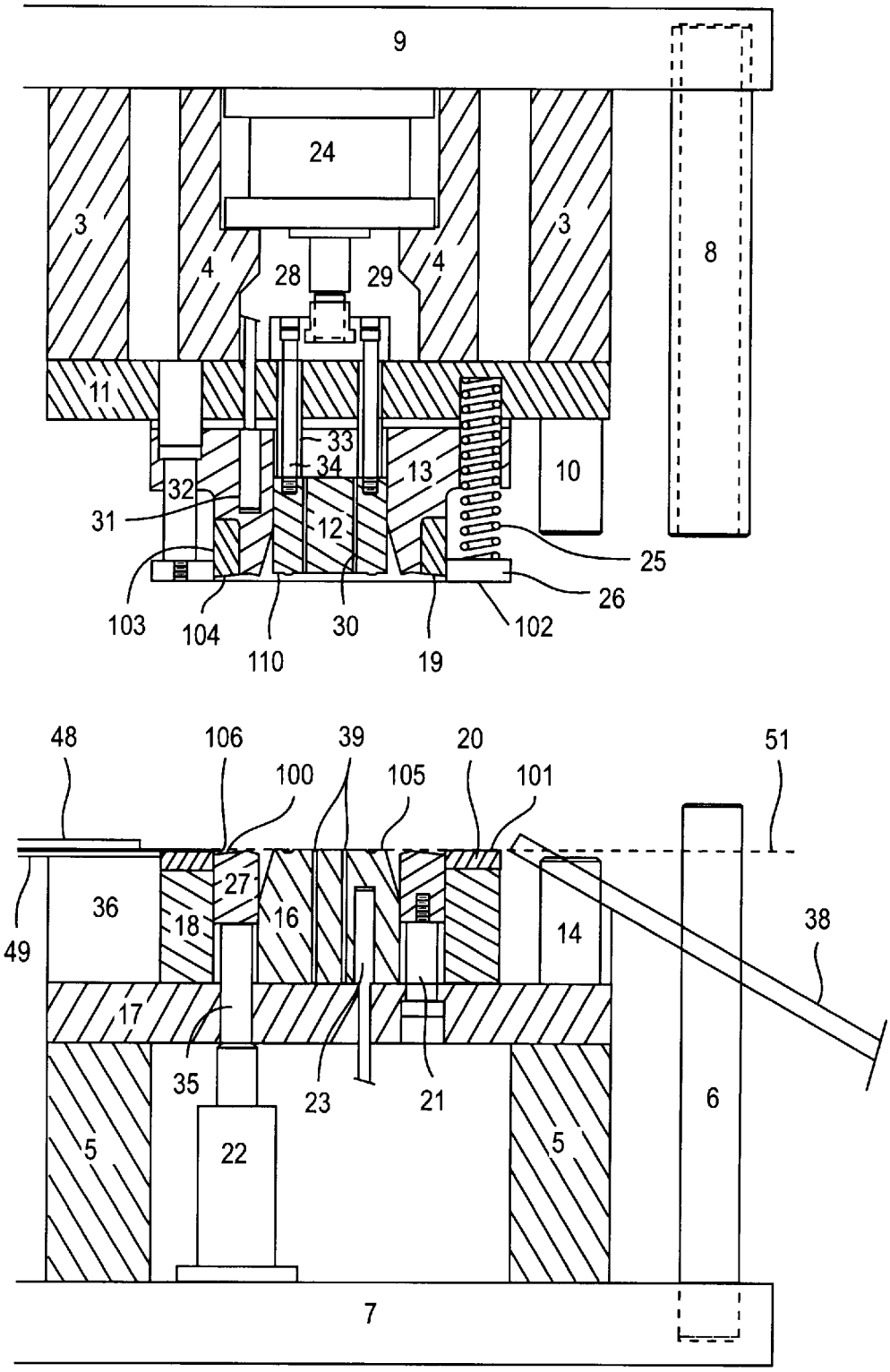

FIG. 3 shows the scoring station (FIG. 3*a*) and the cutting and forming station (FIG. 3*b*) of a preferred embodiment of the invention as mounted within the fixed base and the moveable (upper) portion of a press. The press itself is not shown. It could either be a mechanical press or a hydraulic press. Each has its advantages. While the lower portion of each station is shown mounted on a single base and the upper portion of each mounted in a single die shoe, they could be mounted separately. For convenient reference, the numbers associated with each part are listed below with their names, as used in subsequent discussion of their functions.

| | |
|---|---|
| 1 | Parallels (upper scoring die) |
| 2 | Parallels (lower scoring die) |
| 3 | Outer Parallels (upper forming die) |
| 4 | Inner Parallels (upper forming die) |
| 5 | Parallels (lower forming die) |
| 6 | Guide Pins (lower die shoe) |
| 7 | Lower Die Shoe |
| 8 | Bushings (upper die shoe) |
| 9 | Upper Die Shoe |
| 10 | Upper Stop Block |
| 11 | Base Plate (upper forming die) |
| 12 | Part Ejector |
| 13 | Forming cavity (female die) |
| 14 | Lower Stop Block |
| 15 | Stop Block (scoring die) |
| 16 | Forming Punch (male die) |
| 17 | Base Plate (lower forming die) |
| 18 | Support Block for Blanking Die |
| 19 | Blanking Punch |
| 20 | Blanking Die |
| 21 | Shoulder Bolt or Spool |
| 22 | Nitrogen Gas Spring (or air cylinder, or die spring) |
| 23 | Heater (lower Die) |
| 24 | Air Cylinder |
| 25 | Spring |
| 26 | Stripper Plate |
| 27 | Draw Ring |
| 28 | T-Slotted Block |
| 29 | T-Slotted Nut |
| 30 | Air Vent Holes (upper die) |
| 31 | Heater (upper die) |
| 32 | Spool or Shoulder Bolt |
| 33 | Hollow Connecting Rod |
| 34 | Cap Screw |
| 35 | Extension Pin |
| 36 | Support Block for Paper Guide |
| 37 | Support Block for Part Exit Slide |
| 38 | Part Exit Slide |
| 39 | Air Vent Holes (lower die) |
| 40 | Spring |
| 41 | Base Plate (lower scoring die) |
| 42 | Base Plate (upper scoring die) |
| 43 | Stock Lift Pin |
| 44 | Scoring Board |
| 45 | Scoring Board Backing Plate |
| 46 | Scoring Blade |
| 47 | Counter Plate Backing Plate |
| 48 | Stock Guide Cover |
| 49 | Stock Guide Plate |
| 50 | Paper Board Stock |
| 51 | Pattern Waste (Web) |
| 52 | Counter Plate |

100 Surface of Draw Ring (mates with 104 to grip blank)
101 Surface of Blanking Die (mates with 102 to grip stock/pattern waste)

102 Surface of Stripper Plate (mates with 101 to grip stock/pattern waste; also pushes pattern waste off blanking punch upon opening of die)

103 Outer Surface of Blanking Punch (mates with 106 to cut blank)

104 Surface of Blanking Die & Cavity (mates with 1100 to grip blank)

105 Surface of Forming Punch (mates with 1 10 to grip blank during forming)

106 Inner Surface of Blanking Die (mates with 103 to cut blank)

107 Edge of Scoring Blade (mates with recess 109 in counter plate to form scores)

108 Surface of Stock Lift Pin (pushed down by surface 111, lifts paper when die opens)

109 Recess in Counter Plate (mates with edge 107 of Scoring Blade to form scores)

110 Surface of Part Ejector (mates with 105 to grip blank during forming)

111 Center Surface of Counter Plate (Presses against 108 and grips paper board when die closes)

The operation of the tray-forming station will be shown schematically in FIGS. 5*a–f*, to be discussed below. The general arrangement of the principal parts of the tray-forming station will be described in this section. In the two views of FIG. 3, a continuous strip of paper stock 50 is indexed into position within the tray-forming station by moving from the left to right of the figures, first through the scoring station (3*a*) and then through the tray-forming station (3*b*). As previously explained, the paper stock is moved intermittently for a distance equal to, or typically a fraction of, the distance, e.g., one-half between the center lines of the scoring and tray-forming station. A region of the paper stock is scored and a tray is formed from a previously scored region of the stock in a single movement of the press. The finished trays are ejected onto the conveyor system, which is located at the right side of the figure, although not shown here.

Figure 4:
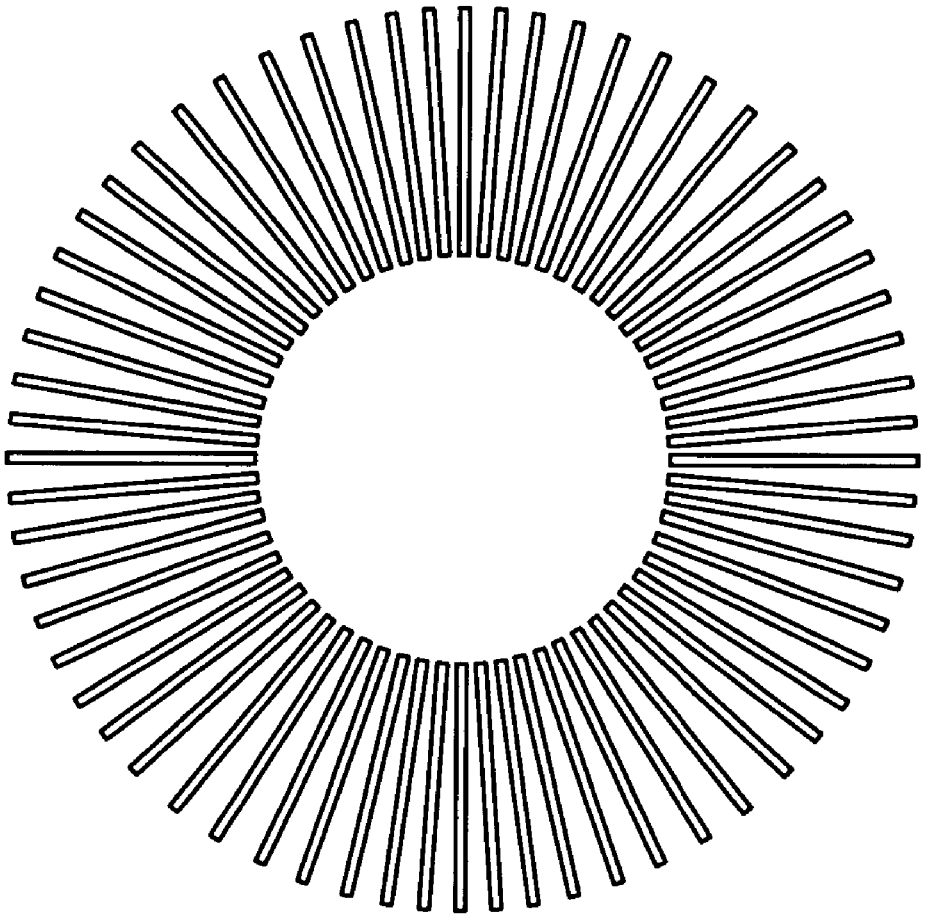
FIG. 4 illustrates a scoring pattern for a circular tray.

The leading section of the paper increment is scored (FIG. 3*a*) by scoring knives 46 which compress lines into the paper which are appropriate for the shape of the tray. For example, FIG. 4 illustrates the typical scoring pattern for a round tray. If the tray were rectangular, the scoring would be principally located where corners are to be formed. At the same time, a previously scored section is formed into a tray (FIG. 3*b*). The bottom parts of the tray-forming die set are mounted in a fixed position in the lower die shoe 7, while the top parts of the die set are mounted on the moveable die shoe 9. The top and bottom parts of the die set grip the strip of paper stock and cut the stock into the shape of the tray to be formed. Then the tray is formed by drawing the cut shape over a forming punch 16 (the male portion of the die set) as the upper die set moves downward with die shoe 9. After forming the tray, the die shoe 9 returns to its starting position, and the tray is ejected from the die by part ejector 12 and moved forward to the conveyor (not shown) by the next movement of the paper stock 50. Since heat may be needed to assist in forming the trays and to help evaporate the moisture in the paper stock, heating elements 23 and 31 may be provided for either the upper or lower dies, or both. To limit thermal expansion and contraction, which could affect the die set alignment, use of metals having a low coefficient of thermal expansion are preferred.

When the fresh paper stock 50 is moved into position in the scoring station (FIG. 3*a*), the die shoe 9 is moved down by the press motion so that the scoring knives 46 mounted on scoring board 44 compress the paper stock 50 between the scoring knives 46 and recessed grooves 109 in counter plate 52, which is mounted on backing plate 47. The force exerted on the paper stock is determined by the press until contact is made with stop block 15, which stops the downward movement and prevents cutting through the paper. The scoring knives 46 are supported on backing plate 45. As previously explained, the purpose of the scoring station is not to cut through the paper stock, but to dent it in a pattern which facilitates forming the finished tray in the tray-forming station. For example, in a round tray, the scoring pattern typically would be circular and uniformly define the sides of the tray which was to be formed as shown in FIG. 4. This scoring assures that the forces applied to the paper in forming the tray produce a uniform side and edge on the tray. Lift pin 43 is mounted within base plate 41 on spring 40. It moves downward during the scoring step, and returns to its starting position as the center surface 111 of the counter plate 52 moves upward. This movement of lift pin 43 serves to lift the scored paper off the knives 46. A similar arrangement may be included at the blanking die 20 and block 18 to lift the paper stock after a tray has been formed.

The portion of the paper stock which had been scored in a previous cycle is indexed into position in the tray-forming station at the same time that a fresh unscored region of the stock is moved into position in the scoring station. The edges of the continuous strip of paper stock are retained within stock guide cover 48 to minimize the possibility of buckling the paper as it is moved into position. The parts of the tray-forming station mounted on the movable die shoe 9 are stripper plate 26, forming cavity 13 (the female portion of the die), and part ejector 12. Stripper plate 26 is spring-loaded by a set of springs 25 in order to return the stripper plate to its starting position when the upper die shoe 9 moves upward after a tray is formed. The movement of the stripper plate 26 is guided by a set of spools 32. The portions of the tray-forming station which are not moveable and mounted on the base plate 17 are the blanking die 20 supported on block 18 and the forming punch 16 of the die set. The draw ring 27 is movably mounted on the base plate 17 and is supported by pressure in gas spring 22 (other types of springs could be substituted). When the force exerted by the press motion exceeds that available from the spring pressure on the draw ring 27, it moves downward. When the press moves the upper portion of the tray-forming station upward (after a tray has been formed), the draw ring 27 moves back to its initial position as shown here. The paper stock is cut in place by hardened edge 19, which is mounted on the outer edge of the forming cavity 13.

TRAY-FORMING SEQUENCE

The five sections of FIG. 5 illustrate the steps by which a tray is formed according to the invention. Only the essential elements are shown here for clarity, but their location in the tray-forming station can be seen in FIG. 3*b*, and the parts have the same numbers. FIG. 5*a* shows an edge view of a scored portion of the web of paper stock 50 in position and ready to be formed into a tray. The upper and lower sections of the die set are in the starting position as in FIG. 3*b*. It should be noted that, in general, these parts will be concentric. When a circular tray is to be made, they will be round, but if an oval shape or generally rectangular shaped tray is to be made, the die parts will still be concentric, although not round.

Figure 5A:
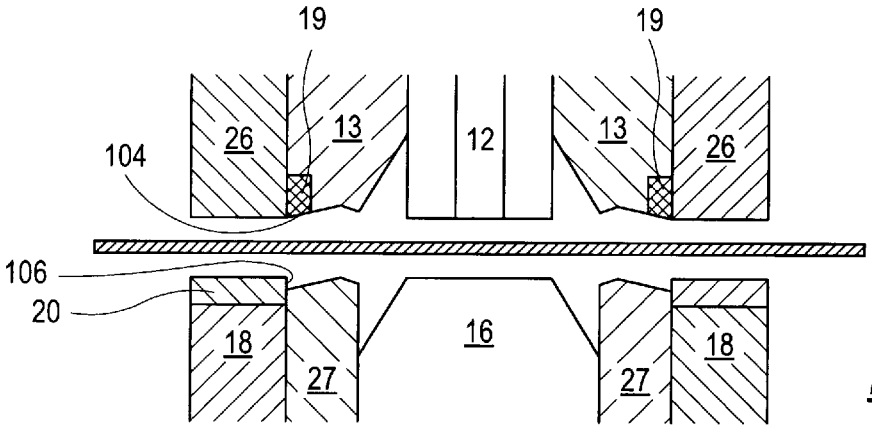
FIGS. 5*a–f* illustrate the action of the tray-forming station in cutting and forming a tray.
Figure 5B:
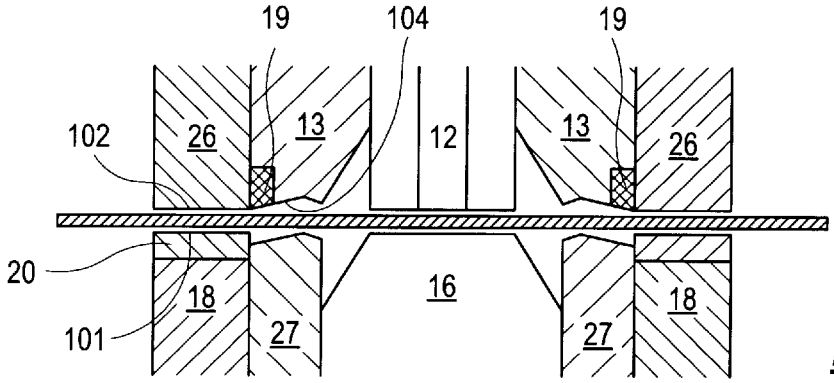

In FIG. 5*b*, the forming cavity form 13 has been brought down by the hydraulic press so the leading edge 104 of blanking punch 19 comes into contact with the paper stock 50. The paper is caught between the top surface 101 of the blanking die 20 and bottom surface 102 of the stripper plate 26, and then the knife edge 104 cuts out a blank which is immediately formed into a tray in one movement of the press. The remaining portion of the paper stock is held in place between stripper plate 26 and the surface 101 while the tray is formed, as can be seen in FIGS. 5*c–d*.

Figure 5C:
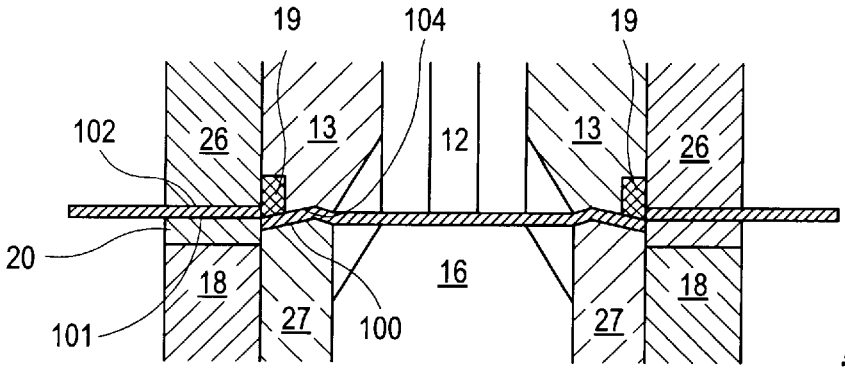
Figure 5D:
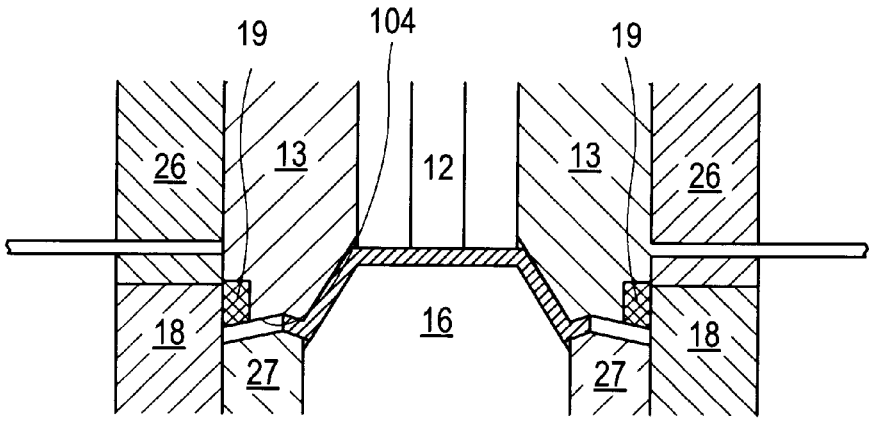

In FIG. 5*c*, the edges of the paper stock are held between the surface 100 of the draw ring 27 and the outer surface 104 of forming cavity 13, which move downward together to draw the paper over the lower forming punch 16 to form a tray. The edges of the paper, being under tension, move inward as shown in FIG. 5*d*. At the bottom of the travel, the maximum pressure is applied for a period (the dwell time) sufficient to set the shape of the container.

Referring back to FIG. 3*b*, air vent holes 30 and 39 are provided in both the forming cavity 13 and forming punch 16 to remove air trapped between them and the paper blank which is being formed into a tray.

Figure 5E:
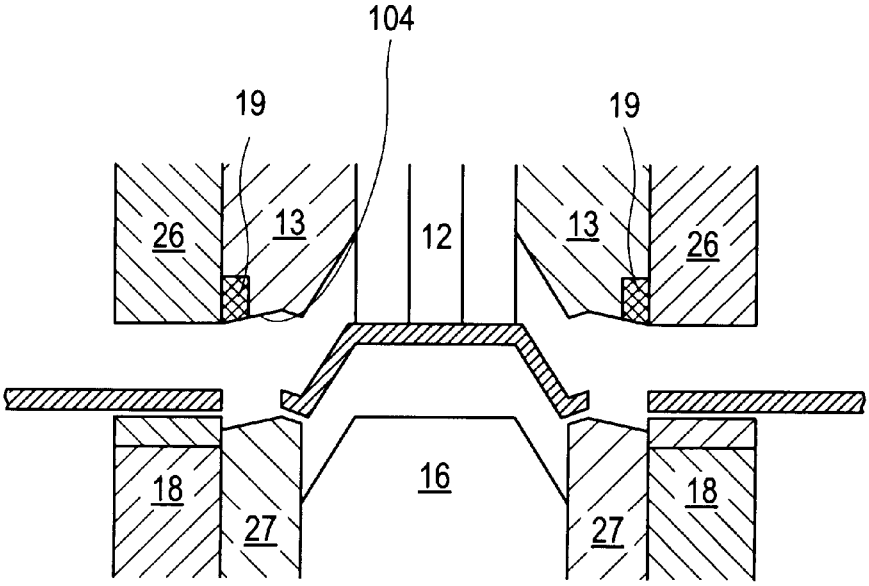
Figure 5F:
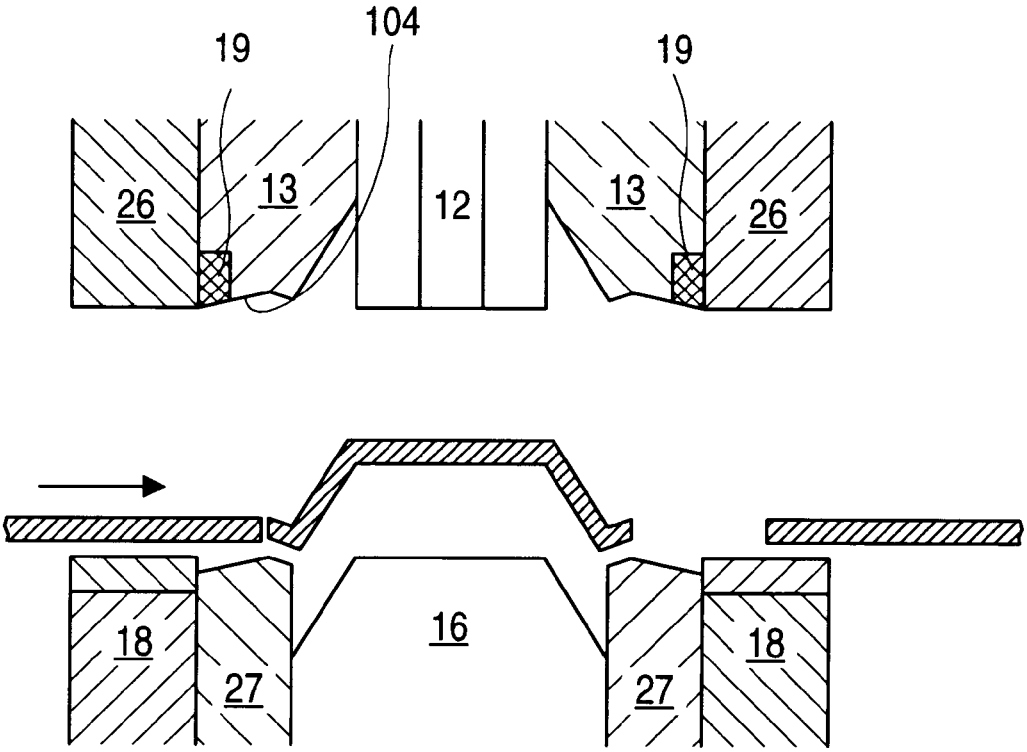

After the tray has been formed, the upper section of the die set moves upward and its elements return to their starting positions. The tray may remain in position on the upper die, and it is ejected by movement of the part ejector 12 by air cylinder 24 as shown in FIG. 5*e*. The finished tray is then moved out of the tray-forming station by the indexing of the paper web into position for the next cycle, as shown in FIG. 5*f*, and moved onto exit slide 38 leading to the conveyor, and then to the stacking station. If desired, the paper web may be lifted by an arrangement similar to lift pin 43 used in the scoring section as discussed above.

As has been previously discussed, the paper retains its alignment as it passes through the machine of the invention. The blank has no opportunity to change its orientation before being formed into a tray. Thus, the orientation of the paper fibers in the stock is identical for each tray, at least insofar as the roll of paper stock is of uniform quality. Consequently, it is now possible to shape the dies to accommodate the behavior of the paper during forming, depending on whether it is in the direction of the fibers (the "machine direction") or across that direction (the "cross direction"). This provides the ability to closely control the final shape of the tray and to assure its uniformity. Also, it now becomes possible to make trays having shapes which have not been feasible when using equipment in which the blanks are separated and moved to a forming station.

There are other advantages which follow from the improved tray-forming process of the invention. When there are fewer rejected trays, there is less waste paper. This reduces costs and increases the number of acceptable trays which each die set can produce during its useful life. Finally, access to the scoring and forming sections is easier, and the time necessary to change over to another tray style is reduced, again providing greater efficiency in production and lowering costs.

What is claimed is:

1. An apparatus for forming discrete three-dimensional containers from a continuous roll of flat paper stock by scoring said stock, and thereafter simultaneously cutting and forming said containers comprising:

a) transfer means for transferring said stock to a scoring station and, thereafter, to a combined cutting and forming station by intermittent movement of a length of said stock equal to, or a fraction of, the distance between the centerline of said scoring station and the centerline of said cutting and forming station;

b) scoring means comprising a set of scoring knives and a set of opposing recesses in a counter block, said scoring knives mounted on a hydraulic or mechanical press means for movement normal to said stock and disposed to score said stock appropriately for the shape of the container to be formed;

c) cutting and forming means comprising a forming cavity, a blanking punch, a stripper plate, draw ring, a blanking die, and a forming punch die, mounted on said press means for movement normal to said stock and cooperating to cut said stock after scoring at the outer edges of the container to be formed and to form said container thereafter in a single movement by gripping the cut edges of said container and drawing said cut stock over said forming punch until said forming cavity engages said forming punch, thereby forming a finished three-dimensional container;

d) ejecting means to separate the three-dimensional container formed in (c) from said forming cavity and the remainder of said stock.

2. An apparatus of claim 1 wherein said scoring means of (b) is provided with a spring loaded lift pin which lifts scored paper stock off said scoring knives.

3. An apparatus of claim 1 wherein said cutting and forming means of (c) comprises an assembly movably mounted on said press comprising concentric elements consisting of said forming cavity, said blanking punch, and said stripper plate.

4. An apparatus of claim 1 wherein said cutting and forming means of (c) comprises an assembly fixedly mounted on said press consisting of concentric elements consisting of said forming punch, said draw ring, and said blanking die.

5. An apparatus of claim 3 wherein said forming cavity comprises an independently moveable part ejector for ejecting a container after it has been formed.

6. An apparatus of claim 5 wherein said independently moveable part ejector corresponds to the bottom of said container.

7. An apparatus of claim 5 wherein said independently moveable part ejector is connected to and moved by an air cylinder.

8. An apparatus of claim 3 wherein said forming cavity is connected to and moved by said press.

9. An apparatus of claim 3 wherein said blanking punch is mounted around said forming cavity and corresponds to the outer edge of the container to be formed.

10. An apparatus of claim 3 wherein said stripper plate is spring-loaded.

11. An apparatus of claim 1 wherein said forming punch and forming cavity contain passageways for removing air trapped between said paper stock and said forming punch and forming cavity.

12. An apparatus of claim 4 wherein said draw ring is mounted on a spring means attached to said press to permit vertical movement when contacted by said forming cavity.

13. An apparatus of claim 4 wherein said blanking die is mounted in a fixed position in the base of said press to engage said paper stock with said stripper plate and to provide an edge against which said blanking punch moves to cut said stock.

14. An apparatus of claim 1 wherein said ejecting means of (d) comprises a part ejector portion of said forming cavity movably mounted to disengage said container from said forming cavity.

15. An apparatus of claim 14 wherein said part ejector portion comprises the base of said forming cavity mounted to be moved by an air cylinder.

16. An apparatus of claim 1 further comprising a waste removing means disposed to receive the unused portion of said paper stock after each intermittent movement of (a).

17. An apparatus of claim 16 wherein said waste removing means comprises a vacuum source disposed to move said unused portion of said paper stock.

18. An apparatus of claim 1 further comprising a container transfer means disposed to receive the three-dimensional tray ejected in (d).

19. An apparatus of claim 18 wherein said container transfer means is an air conveyor table.

20. A process for forming discrete three-dimensional containers from a continuous roll of flat paper stock comprising:

a) transferring said stock to a scoring station and, thereafter, to a combined cutting and forming station by intermittent movements of a length of said stock equal to, or a fraction of, the distance between the center line of said scoring station and the centerline of said cutting and forming station;

b) simultaneously scoring said stock and cutting and forming previously scored stock into a finished three-dimensional container;

c) ejecting said container formed in (b) from the remaining stock said cutting and forming station; and d) repeating steps (a) through (c) to form multiple three-dimensional containers.

21. A process of claim 20 further comprising the step of:

e) removing as waste stock which has not been cut and formed into a container in step (b).

22. A process of claim 21 further comprising the step of:

f) transferring the containers ejected in step (c) to a stacking station.

23. A process of claim 20 wherein step (a) comprises unrolling said stock continuously into a loop sufficient to accommodate said intermittent movements of said stock.

24. A process of claim 20 wherein step (b) comprises scoring said stock in the shape of the container to be formed by compressing said stock between a set of scoring knives arrayed appropriately for the shape of the container to be formed and a counter block having recesses corresponding to the edges of said scoring knives.

25. A process of claim 24 wherein said scoring knives are mounted on the fixed base of a hydraulic or mechanical press, and said counter block with corresponding recesses is mounted on a moveable portion of said press.

26. A process of claim 25 wherein a spring loaded element mounted on said fixed base engages and lifts said paper stock after said scoring knives have compressed said stock.

27. A process of claim 20 wherein said previously scored paper stock is cut and formed into a three-dimensional container by first gripping said paper stock between two surfaces defining the shape to be cut and, thereafter, cutting said stock by passing a blanking punch mounted on a forming cavity through the paper stock at surfaces gripping said stock to separate the cut stock from which a container is to be formed.

28. A process of claim 27 wherein said cut stock is gripped at its edges between said forming cavity and a draw ring and drawn down over a forming punch until said cut stock has been formed into the desired three-dimensional container.

29. A process of claim 27 wherein said blanking punch and said forming cavity are mounted on a moveable portion of a hydraulic or mechanical press and said forming punch and said draw ring are mounted on a fixed base of said press.

30. A process of claim 20 wherein said ejecting of said container of (c) comprises moving a part ejector portion of said forming cavity to engage said three-dimensional container and to dislodge it from said forming cavity.

* * * * *

UNITED STATES PATENT AND TRADEMARK OFFICE

CERTIFICATE OF CORRECTION

PATENT NO.: 5,904,643

DATED: May 18, 1999

INVENTOR(S): Edward J. Seeberger et al.

It is certified that errors appear in the above-identified patent, and that said Letters Patent is hereby corrected as shown below.

Cover page, [54], after "FORMING" insert --PROCESS--

Signed and Sealed this

Nineteenth Day of October, 1999

*Attest:*

*Attesting Officer*

Q. TODD DICKINSON

*Acting Commissioner of Patents and Trademarks*